United States Patent [19]

Croisant

[11] 4,009,677

[45] Mar. 1, 1977

[54] RADIAL THRUST APPARATUS FOR HIGH THRUST TROLLING MOTOR

[75] Inventor: Elmer E. Croisant, Oshkosh, Wis.

[73] Assignee: Brunswick Corporation, Skokie, Ill.

[22] Filed: Sept. 4, 1975

[21] Appl. No.: 610,303

[52] U.S. Cl. ..... 115/18 E

[51] Int. Cl.[2] ..... B63H 5/13

[58] Field of Search ..... 115/18 R, 18 E, 18 A, 115/17, 34 R; 290/43, 54; 310/87

[56] References Cited

UNITED STATES PATENTS

| | | | |
|---|---|---|---|
| 2,749,776 | 6/1956 | Fischer et al. | 115/34 R |
| 3,703,642 | 11/1972 | Balaguer | 115/18 E |
| 3,723,839 | 3/1973 | Cramer | 115/18 E |
| 3,797,448 | 3/1974 | Cramer | 115/18 E |
| 3,906,887 | 9/1975 | Kappas | 115/18 E |

*Primary Examiner*—Trygve M. Blix
*Assistant Examiner*—Stuart M. Goldstein
*Attorney, Agent, or Firm*—Andrus, Sceales, Starke & Sawall

[57] ABSTRACT

An electric trolling motor includes a lower unit with a cylindrical motor housing closed at the aft end by a planetary gear-reduction subassembly. A motor shaft supporting hub member telescopes into the housing and has clamped thereagainst an annular gear with clamping bolts passing therethrough and threaded into the hub member. Planetary gears carried by a cage engage the annular gear. A propeller shaft is fixed to the cage and journaled in a second hub portion of the housing. A sun gear meshes with the planetary gears and has an opening aligned with an opening in a hub portion of the first hub member to receive the motor shaft. The shaft openings in the first and second hub members have shaft bearings in spherical seats and rotating seals. The spherical seats provided proper alignment of the shafts. The planetary gear subassembly drops onto the motor shaft with both hub members abutting the motor housing and secured thereto by bolts. The motor shaft and sun gear have complementing interlocking surfaces to establish rotatable interconnection. The opposing surfaces of the sun gear and the cage have thrust bearing surfaces with the motor shaft holding the sun gear in cage abutting relation.

7 Claims, 4 Drawing Figures

RADIAL THRUST APPARATUS FOR HIGH THRUST TROLLING MOTOR

CROSS REFERENCE TO RELATED APPLICATION

This application is a co-pending application of Ser. No. 610304, entitled "High Thrust Trolling Motor", both applications being owned by the same assignee.

BACKGROUND OF THE INVENTION

This invention relates to a radial bearing apparatus for a high thrust trolling motor.

In the art of trolling, small electric driven outboard motor units are mounted to the transom of a boat and employed for slow speed maneuverability and positioning of the fishing boats. The electric drive motor is housed within the lower unit and coupled to drive a suitable propeller. The electric trolling motor unit may be specially employed in bass fishing and the like where the motor unit is primarily employed for limited maneuverability within a fishing area to properly locate the boat with respect to and positioning of the fishermans lines. The motor unit is turned for steering of the boat by a foot control coupled by push-pull cables to a turning gear means in the head of the motor unit and the speed is similarly controlled from a foot control connected in circuit with a battery and the motor. A separate high powered internal combustion outboard motor is normally provided for rapid propulsion of the water-craft to the fishing location or spot after which the trolling motor is employed. A particularly unique and satisfactory motor unit construction is illustrated in the co-pending application of Charles F. Alexander, Jr. and entitle "HIGH THRUST TROLLING MOTOR" which was filed on the same day as this application and is assigned to the same assigned.

As more fully disclosed therein, the trolling motor includes a lower unit within which an electric motor is housed and coupled to a separate propeller drive shaft by a reduction gear means to establish a low speed and high torque to turn a large propeller that produces high thrust. By increasing the diameter of the propeller unit an increase in the static thrust is obtained for a given motor horsepower. The gear reduction means is a planetary gear system which is uniquely adapted to practical implementation in a low cost trolling motor. The planetary gear system uniquely distributes the load between the planet gears. Consequently, relatively inexpensive plastic, and sintered gear members can be employed. The planetary gear system is formed as a separate self-contained unit or subassembly to close the corresponding end of the lower unit with a convenient coupling between the propeller shaft and the motor shaft. The addition of the gear subassembly increases the overall length of the lower unit which is therefor constructed as a compact unit.

SUMMARY OF THE INVENTION

This invention relates to a trolling motor having a gear reduction means coupling an electric motor to a propeller shaft and particularly to bearing support means for establishing accurate alignment of the propeller and water shaft means. In accordance with the present invention, a radial bearing means supports the propeller shaft and includes a spherical seat means. The gear means includes an output gear secured to said propeller shaft. The spherical support means establishes proper alignment of the propeller shaft.

In a particularly unique embodiment of the present invention, the gear reduction means includes a housing which is secured to a motor housing. A planetary gear system is mounted within the separate gear housing. The gear system includes a planetary gear cage secured to the propeller shaft which is rotatably supported within the gear housing by a radial bearing which is rotatably supported within the gear housing by a radial bearing means having a spherical support means to produce proper alignment of the shaft. In accordance with a further novel feature of the preferred embodiment of the invention, the sun gear is mounted in alignment with the propeller shaft and includes a rotor shaft coupling opening. The housing includes a motor shaft opening aligned with the coupling opening. A radial bearing including a spherical support means is provided to support the motor shaft in coupling engagement with the sun gear when the gear housing is secured to the motor housing.

The present invention has been found to provide a simple, reliable means of establishing and maintaining the proper coupling and alignment of the motor and propeller shaft means in the lower unit of an electric trolling motor apparatus.

Applicant has found that the shaft bearing assembly applied to the trolling motor results in a compact construction which properly supports the shafts in alignment with the gear reduction means.

BRIEF DESCRIPTION OF THE DRAWING

The drawing furnished herewith illustrates a preferred construction of the present invention in which the above advantages and features are clearly disclosed as well as others that will readily be understood from the following description.

In the drawing.

DESCRIPTION OF THE ILLUSTRATED EMBODIMENT

Figures 1, 2, 3, 4:
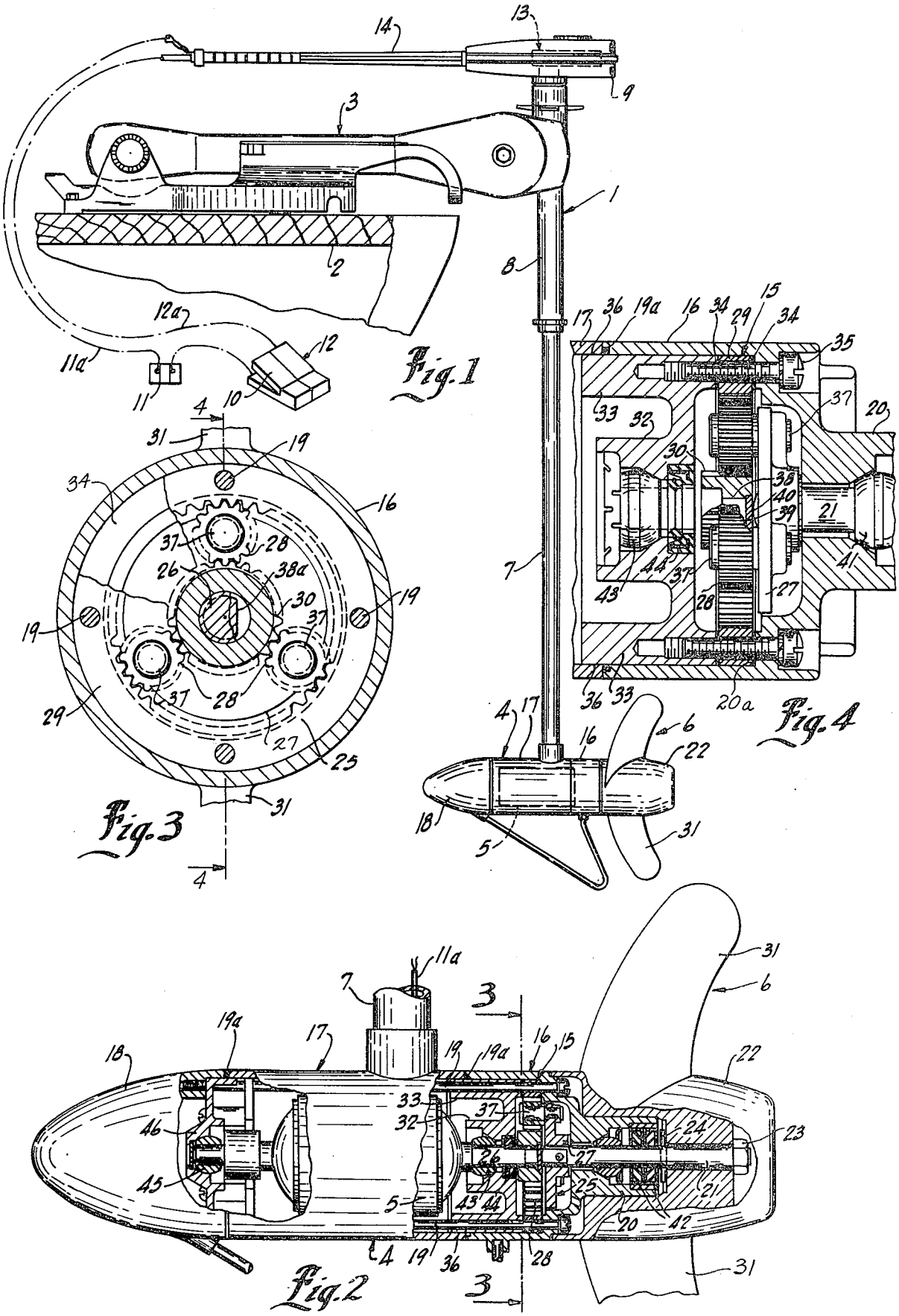
FIG. 1 is a side elevational view of a trolling motor attached to the mounting deck forming a part of a watercraft, not shown.
FIG. 2 is an enlarged side elevational view of the lower units with parts broken away and sectioned to illustrate the construction of one embodiment of the present invention.
FIG. 3 is an enlarged view taken generally on line 3—3 of FIG. 2.
FIG. 4 is a vertical section taken generally on line 4—4 of FIG. 3.

Referring to the drawing and particularly to FIG. 1 a trolling motor 1, particularly adapted for bass fishing and the like, is illustrated mounted to a horizontal support wall 2 which will form the appropriate deck or mounting means of a watercraft, not shown. Generally watercraft for bass fishing includes a forward deck 2 to which the trolling motor 1 is pivotedly secured by suitable pivot assembly 3 for selective positioning of the motor in propelling position shown in FIG. 1. The assembly 3 permits positioning in a raised alternate position lying on the deck 2. Generally the trolling motor 1 includes a lower unit 4 within which a small electric motor 5 is housed and coupled to drive a propeller unit 6. The lower unit 4 is secured to the lower end of a support tube member 7, which may conveniently be a suitable pipe-like member. Supporting pipe 7 is suitable rotatably journalled or mounted in a swivel tube support 8 which terminates at the upper end within a steering housing or head 9. The swivel tube 8 is connected to the pivotal mount assembly 3. The motor 5 is selectively energized from within the boat 2 to vary the speed of propeller 6 and thereby the propulsion forces and the trolling motor 1 is pivoted within the swivel tube 8 from within the boat support to turn the watercraft. Generally, suitable foot control means are employed and are diagrammatically illustrated including a speed control foot unit 10 connected in circuit with a battery 11 and suitable connecting leads 11a which extend through the upper head 9 and down through the conduit or pipe 7 to a suitable control circuit, not shown, for energizing of the motor 5. Similarly, a positioning foot control 12 is connected by a push-pull cable **12*a* to the upper head 9 within which a suitable rotating gear system 13 or the like couples the push-pull cable 12a to the upper end of pipe 7, which terminates within housing 9, for selective rotation thereof. In the illustrated embodiment of the invention, the motor 1 is also provided with an upper handle 14 for selective pivoting and positioning of the steering head 13. The motor 5 is coupled to the propeller 6 through a special speed reduction gear unit 15, which in the illustrated embodiment of the inveniton is formed as a separate subassembly and connected as an integrated end closure to the lower unit 4**.

Generally, the illustrated embodiment of the unit 15 includes a cup-shaped gear housing 16 having an outer cylindrical end portion corresponding to the diameter of the motor housing 17 to which the supporting conduit 7 is secured. The opposite end of the housing 17 is closed by a suitable nose cone or housing 18. A pair of conventional clamping bolts 19 extend through the several housings 16 – 17 and thread into the housing 18 to draw the several housing members into firm abutting and clamped engagement. O-ring seals **19*a* are located between the abutting housing sections to create a liquid tight enclosure of the motor and associated equipment. The subassembly and particularly the cup-shaped gear housing 16 further includes a coaxial end hub 20 within which a propeller shaft 21 is rotatably mounted. The hub 22 of the propeller 6 telescopes over the shaft 21 and is locked in position by an outer locking nut 23. A pin 24 extends through the shaft 21 and into an appropriate recess in the propeller hub 22 to further interlock the hub to the shaft for rotation of the propeller 6**.

The inner end of the shaft 21 terminates within the subassembly 15 and is connected by a reduction gear means or train 25 to the motor shaft 26 which extends from the motor 5 and into the subassembly 15 with a releasable slip-type interconnection to the reduction gear train 25.

The gear train 25 is illustrated in a preferred embodiment as a planetary gear means and includes a rotating planetary gear cage 27 which is pinned or otherwise connected to the shaft 21. A plurality of planetary gears 28 are rotatably mounted in meshing engagement with a fixed annulus gear 29 and an inner sun gear 30 to which the motor shaft 26 is coupled. The planetary gear system is uniquely adapted to the present application because it provides a highly efficient and long life with a relatively large reduction ratio. For example, in a practical application employing a three-inch housing a reduction ratio of 4.2 to 1 is obtained to thereby significantly reduce the rotational output and to establish a large torque output at the propeller unit 6. The propeller unit 6 includes a pair of broad blades 31 of a long radial extent which convert the high torque achieved by the reduction gear to high thrust for improved maneuverability of the boat 2.

More particularly in the illustrated preferred embodiment of the present invention, the housing 16 is a generally cup-shaped member with an outer end or base portion including a reduced diameter hub 20 and an inner cylindrical portion for mating with the cylindrical motor housing 17. The cylindrical portion of the cup-shaped housing 16 has an inner diameter sized to receive the annulus gear 29, with such gear abutting an inner annular planar base surface **20*a*. The annulus gear 29 is clamped to the surface 20*a* by a motor shaft bearing hub member 32 having an outer cylinder portion 33 telescoping in close fitting engagement within the inner cylindrical portion of the housing 16. Gaskets 34 are disposed to the opposite sides of the annulus gear 29 and the elements are clamped into an integrated unit by a pair of clamping bolts 35 which extend through the outer base of the cup-shaped housing 16, through the gear 29 and the associated gaskets 34 and thread into a suitably taped openings in the cylindrical portion 33 of the hub member 32. The clamping bolts 35 are diametrically located on the assembly and offset 90° from the mounting openings for the motor assembling bolts 19, shown in FIG. 2. The cylindrical portion 33 of the hub member 32 may project outwardly from the housing 16 slightly to provide a support and guide portion which projects into the cylindrical motor housing 17, as most clearly shown at 36 in FIGS. 2 and 4. The O-ring seals 19*a* may be provided at the abutting junction therebetween by a small recess provided in the inner corner of the housing 16 immediately adjacent the guide portion 33. The annulus gear 29 is thereby rigidly clamped in position as a fixed gear of the planetary gear train 25**.

The opposing faces of the cup-shaped housing 16 and the hub member 32 are recessed to define a gear chamber within which the planetary gear train 25 is disposed. In particular, the sun gear cage 27 is located within a suitable recess in the cup-shaped housing 16. The cage 27 is shown as a disc-like plate coaxially aligned with the sun gear 30 with the three planetary gears 28 secured to the cage in any suitable manner as by staking or rivets 37 to rotatably support the planetary gears in meshing engagement with the annulus gear 29 and with the sun gear 30. The sun gear 30 is a conventional small circular gear member which mates with the several planetary gears 28 and in the illustrated embodiment is particularly formed with a central stepped opening 38 which is adapted to receive the inner end of the motor shaft 26 which is correspondingly shaped.

As most clearly shown in FIGS. 3 and 4, the opening 38 and the outer end of the motor shaft 26 are similarly formed with keying portions in the form of an offset chordal locking or keying flat surface **38*a* providing rotational interlock of the shaft 26 to the sun gear 30. The inner end of the opening 38 is shown closed by a thrust washer 39 which abuts a bearing means 40 on the adjacent surface of cage 27. In the illustrated embodiment, the inner end of the propeller shaft 21 projects inwardly slightly from the face of the cage 27 and is rounded to present a bearing surface 40 to the washer 39. In the assembled relation, sun gear 30 is held firmly on the shaft 26 and is coupled thereto by the offset drop opening 38 to transmit the output of the motor 26 through the planetary gear system 25 to the propeller shaft 21. The rotation of the small sun gear 30** results in the rotation of the planetary gears 28 about their own axis, with the meshing with the fixed annulus gear 29 generating a rolling movement thereon about the axis of the sun gear 30 in accordance with well-known functions. The rotary motion is transmitted through the cage 27 to the propeller shaft 21 and thus to the propeller.

In the illustrated embodiment of the invention, the propeller shaft 21 is rotatably supported within the hub 20 by a single spherically mounted thrust bearing 41 secured within an outer recessed hub portion. The spherical support of the single radial bearing as illustrated insures that the propeller shaft and the attached planetary gear cage and gears may properly align with the gear system and particularly the annulus and sun gears in the illustrated embodiment. The outer end of the hub is sealed by a pair of suitable rotary seals 42 of any desired or suitable construction. As such elements are well-known and can be readily provided by the ordinary worker skilled in the art, no further description is given.

Similarly the motor shaft hub member 32 is recessed, with an outer spherical bearing 43 and an inner rotary seal 44 located immediately adjacent to the gear chamber. The opposite end of the motor shaft 26 may be similarly supported by a sealed spherical bearing assembly 45 clamped between the opposite end of the housing 17 and the nose cone housing 18 as at 46.

In the assembly, the planetary subassembly 15 is constructed with the clamping bolts 35 developing an integrated structure. The assembly 15 is dropped over the motor shaft 26, and if necessary, slowly rotated to align the offset interlocking chordal portion **38*a* with the corresponding flat portion of the shaft 26 such that the assembly will drop into interlocking engagement. The assembly bolts 19 are then inserted and drawn up tightly with the thrust washer 39 of the sun gear 30 moving into bearing relationship with the inner end of shaft 21 to complete the assembly of the lower unit for receiving of the propeller unit 6. The hub 22 of propeller unit 6 can be dropped onto the assembled unit with the pin 24 aligned with the connecting recess and clamping nut 23** tightened to complete the assembly.

The present invention thus provides an improved shaft bearing support permitting a compact gear coupling means for an electric trolling motor.

Various modes of carrying out the invention are contemplated as being within the scope of the following claims particularly pointing out and distinctly claiming the subject matter which is regarded as the invention.

I claim:

1. In an electric trolling motor apparatus having a lower cylindrical unit including an electric motor having a motor shaft and a drive propeller, an improvement in the coupling of the motor shaft to the propeller, comprising an output gear reduction means for connecting the electric motor shaft to the propeller and having input gear means for providing a rotating input to the gear reduction means and an output drive gear means providing a rotating output of a substantially lesser rate than said rotating input, said motor shaft being connected to said input gear means, said propeller having a propeller shaft secured to said output drive gear means, a gear housing having a bearing recess, a radial bearing means secured within said bearing recess for rotatably supporting said propeller shaft, said radial bearing permitting rotational movement of the bearing and including an outer spherical seat located in said recess and establishing coaxial alignment of the motor and propeller shafts and output drive gear means relative to the input gear means of said gear reduction means.

2. In the electric trolling motor apparatus of claim 1 wherein said lower cylindrical unit includes a motor housing supporting said electric motor and said gear housing having an inner end connected to said motor housing and having an outer end, said radial bearing means located within the outer end of said gear housing, said gear housing having a second radial bearing mounted in the inner end of the housing, said second radial bearing including a spherical seat supporting the motor shaft and input gear means for aligning movement of the input gear means relative to said output drive gear means.

3. In the electric trolling motor apparatus of claim 1 wherein said gear reduction means is a planetary gear assembly and said output gear means includes a plurality of planetary gears secured to a supporting cage, said cage being secured to said propeller shaft.

4. In the apparatus of claim 2 wherein said input gear means is a sun gear mounted coaxially of said propeller shaft and having a shaft coupling opening therethrough to receive the motor shaft, said second radial bearing means being mounted within said gear housing in alignment with the shaft coupling opening.

5. In an electric trolling motor apparatus having a propeller supporting unit releasably secured to a motor drive unit, said motor drive unit including a motor shaft, said propeller unit including a generally closed end and an oppositely located open end and having a propeller shaft extending outwardly from said closed end, a radial output bearing secured within the propeller unit and supporting said propeller shaft, a radial input bearing secured within the propeller unit and supporting the motor shaft, each of said radial bearings having an outer spherical seat and a recess supporting the motor shaft and propeller shaft for self-aligning movement of the bearings relative to each other, and a gear reduction means within the propeller unit having an input drive gear means providing a rotational input and connected to said motor shaft and having an output gear means providing a rotational output and secured to said propeller shaft.

6. The apparatus of claim 5 wherein said gear reduction means includes a planetary gear assembly having a planetary gear cage forming a part of said output gear means and secured to said propeller shaft.

7. In the apparatus of claim 6 wherein said gear assembly includes a sun gear forming said input gear means and having a shaft coupling opening aligned with said input bearing, said cage having a thrust bearing portion located in aligned thrust supporting relation to said sun gear.

* * * * *